US007118403B1

(12) United States Patent
Drye et al.

(10) Patent No.: US 7,118,403 B1
(45) Date of Patent: Oct. 10, 2006

(54) CONNECTOR CLIP AND METHOD

(75) Inventors: Jeffrey Drye, Glendale Heights, IL (US); Matthew Williams, Riverside, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/263,661

(22) Filed: Oct. 31, 2005

(51) Int. Cl.
*H01R 13/627* (2006.01)

(52) U.S. Cl. ..... 439/352; 439/358

(58) Field of Classification Search ..... 439/352, 439/358; 285/303, 305, 350, 352
See application file for complete search history.

(56) References Cited

U.S. PATENT DOCUMENTS

| | | | | |
|---|---|---|---|---|
| 4,580,192 | A | 4/1986 | Beun | |
| 4,634,204 | A | 1/1987 | Detter et al. | |
| 4,746,306 | A | 5/1988 | Yurtin et al. | |
| 4,941,838 | A * | 7/1990 | Zinn | 439/350 |
| 4,946,404 | A | 8/1990 | Takenouchi et al. | |
| 5,035,637 | A | 7/1991 | Mathews et al. | |
| 5,542,716 | A * | 8/1996 | Szabo et al. | 285/305 |
| 5,624,271 | A | 4/1997 | Childs et al. | |
| 5,651,689 | A | 7/1997 | Plyler et al. | |
| 5,759,058 | A | 6/1998 | Childs et al. | |
| 5,910,028 | A | 6/1999 | Tsuji | |
| 5,951,063 | A * | 9/1999 | Szabo | 285/303 |
| 6,080,004 | A * | 6/2000 | Kovacik et al. | 439/369 |
| 6,435,895 | B1 | 8/2002 | Fink et al. | |
| 6,544,066 | B1 | 4/2003 | Fukase | |
| 6,772,487 | B1 | 8/2004 | Bachorski et al. | |
| 6,929,499 | B1 * | 8/2005 | Nakamura | 439/352 |
| 2002/0123260 | A1 * | 9/2002 | Ichio | 439/352 |
| 2002/0123261 | A1 * | 9/2002 | DeWitt et al. | 439/352 |
| 2003/0160448 | A1 * | 8/2003 | Takayanagi | 285/305 |
| 2004/0036282 | A1 * | 2/2004 | Rohde et al. | 285/305 |
| 2005/0153593 | A1 * | 7/2005 | Takayanagi et al. | 439/352 |

* cited by examiner

*Primary Examiner*—Tulsidas C. Patel
*Assistant Examiner*—Vladimir Imas
(74) *Attorney, Agent, or Firm*—Susan L. Lukasik; Elias P. Soupos; Dennis K. Sullivan

(57) ABSTRACT

An apparatus includes a female connector (106) having a first shell (302), at least one pot (318), and a latching tab (310) having an opening (314). A male connector (104) has a second shell (214) that fits within the first shell (302), at least one pin (226) located within the second shell (214) and in the at least one pot (318), and a locking tab (310) that is located within the opening (314) in the latching tab (310) and that has a tapered surface (224). A clip (500) has a body (502), at least two legs (504) disposed on the body (502), and a head opening (514) disposed adjacent to the body (502). When the male connector (104) is connected to the female connector (106) the clip (500) is disposed on the female connector (106).

19 Claims, 5 Drawing Sheets

- PRIOR ART -

CONNECTOR CLIP AND METHOD

FIELD OF THE INVENTION

This invention relates to electrical connectors, including but not limited to electrical connectors having more than one pin for use on internal combustion engines.

BACKGROUND OF THE INVENTION

Modern internal combustion engines typically use electrical actuators and sensors. These components are connected electrically to one or more engine control modules (ECMs). A typical ECM may be mounted onto the engine or a vehicle, and may include electronic circuits that interpret sensor inputs and send actuator control signals. Sensors and actuators, or electrical components, are usually connected to various parts of the engine to monitor and control engine operating parameters and functions.

The electrical connections between the ECM and the electrical components are accomplished in part by use of electrical harnesses. Electrical harnesses include bundles or looms of wires that carry electrical signals between the electrical components and the ECM. The electrical connections between the electrical components and the ECM are accomplished with use of electrical connectors. An electrical connector includes a set of mating housings, usually made from plastic, that have one or more pins and corresponding pin receptacles, or pots. Most components designed for operation on an internal combustion engine may be required to be tolerant to excessive heat fluctuations, humidity, vibration, and so forth. For this reason, electrical connectors usually include a variety of locking and sealing mechanisms to protect the integrity of the electrical connection between the pins and their receptacles.

Many electrical connectors use latching mechanisms to ensure that both mating parts of an electrical connector remain securely attached to each other during operation. A recurring problem is accidental or unintentional disengagement of electrical connectors. The disengagement of the electrical connectors may be because of improper initial installation, mishandling of the engine harness after installation, a failure in the latching mechanism of the connector, or other factors. Improper connections on the engine may lead to improper operation of the engine.

Accordingly, there is a need for a cost and labor efficient apparatus and method for ensuring that electrical connectors are connected securely and properly and are not unintentionally disconnected.

SUMMARY OF THE INVENTION

An apparatus includes a female connector having a first shell, at least one pot, and a latching tab having an opening. A male connector has a second shell that fits within the first shell, at least one pin located within the second shell and in the at least one pot, and a locking tab that is located within the opening in the latching tab and that has a tapered surface. A clip has a body, at least two legs disposed on the body, and a head opening disposed adjacent to the body. When the male connector is connected to the female connector the clip is disposed on the female connector.

DESCRIPTION OF A PREFERRED EMBODIMENT

Figure 1:
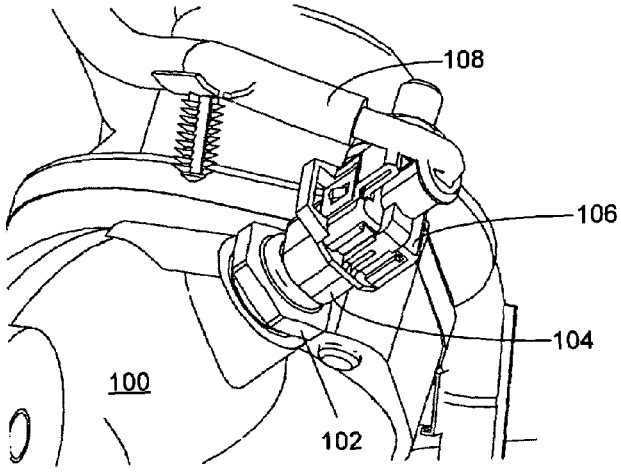
FIG. 1 is a view of a portion of an engine containing a sensor connected to a wire harness.

The following describes an apparatus for and method of securely clipping two mating electrical connectors on an internal combustion engine. An application for an electrical connector is shown in FIG. 1. A portion of an engine 100 includes a sensor 102. The sensor 102 may be a coolant temperature sensor located in an area of the engine 100 that is prone to vibration, humidity, temperature extremes, and mishandling during assembly or installation of the engine 100 in a vehicle. The sensor 102 may be integrated with a male connector 104. The male connector 104 may be made of plastic, and may alternatively be separate from the sensor 102 and attached to the sensor 102 with wires or "pigtails" (not shown). The male connector 104 is latched to a female connector 106. The female connector 106 is connected to a portion of an engine harness 108.

Figure 2A:
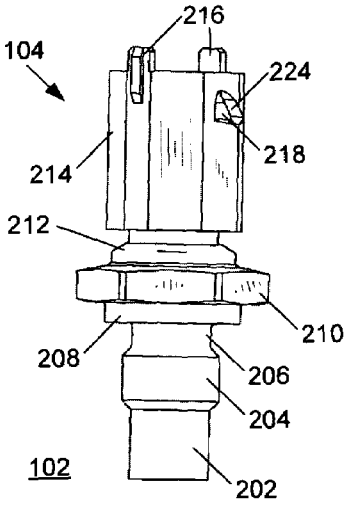
FIGS. 2A through 2C are different views of a sensor having an integrated connector in accordance with the invention.
Figure 2B:
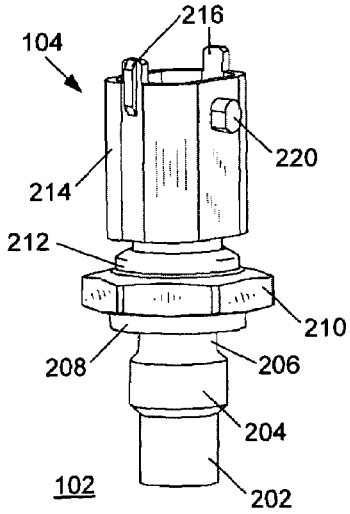
Figure 2C:
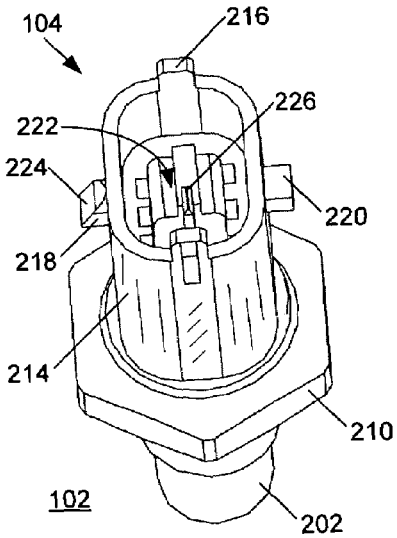

The sensor 102 having the male connector 104 is shown in FIGS. 2A through 2C. The sensor 102 includes the male connector 104, a sensing portion 202, a threaded portion 204, a shoulder 206, a flange 208, a hex-head 210, and a base 212. The sensor 102 may be an engine coolant and/or oil sensor, for example, a sensor manufactured by Siemens under part number S-107978001. The male connector 104 includes a shell 214, two alignment tabs 216, a locking tab 218, a locator tab 220, and a pin cavity 222. The two alignment tabs 216 are placed on diametrically opposed sides of the shell 214 to help align the male connector 104 during assembly. The locator tab 220 and the locking tab 218 are placed on diametrically opposed sides of the shell 214, at locations measuring about 90 degrees from the alignment tabs 216 on the periphery of the shell 214, to help locate and secure the male connector 104.

Figure 3A:
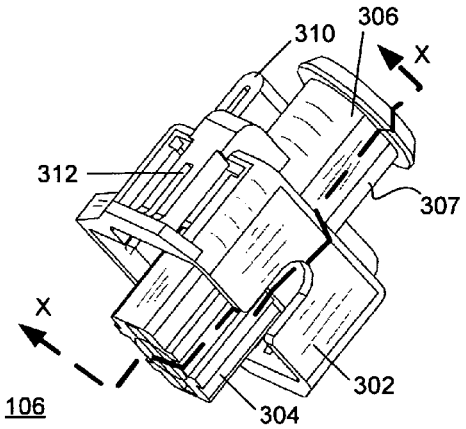
FIGS. 3A through 3C are different views of a connector.
Figure 3B:
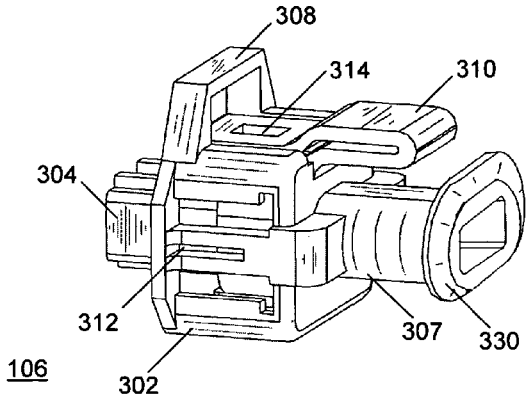
Figure 3C:
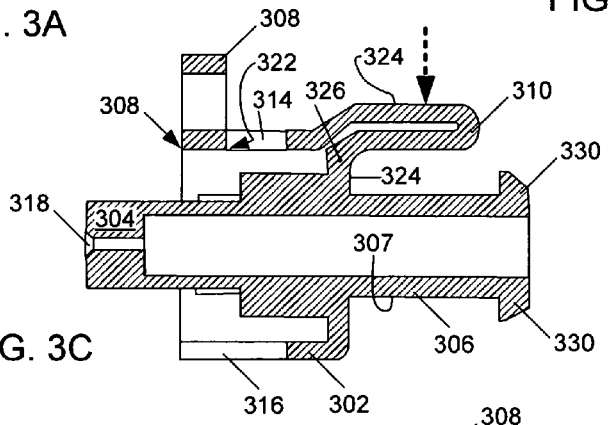

The female connector 106 is shown in FIGS. 3A through 3C. The view of FIG. 3C is a cross section through X—X as shown in FIG. 3A. The female connector 106 has a shell 302, a pot body 304, a bridge 308, a latching tab 310, and a wire housing 306 having an outer surface 307 and a ledge 330. One example of the female connector may be a 2-pole connector manufactured by Bosch under part number 1928403920. The shell 302 is arranged to be larger than the shell 214. When the male connector 104 and the female connector 106 are attached, the shell 214 fits with a clearance fit inside the shell 302. The alignment tabs 216 align the shells 214 and 302, and fit inside a pair of alignment channels 312 in the female connector 106. The locking tab 218, having a tapered surface 224, fits inside an opening 314 in the latching tab 310. The locator tab 220 fits inside a locator notch 316. The pin cavity 222 fits around the pot body 304, allowing a set of pins 226 in the male connector 104 to enter a set of pot openings 318 in the pot body 304 of the female connector 106.

Figure 4:
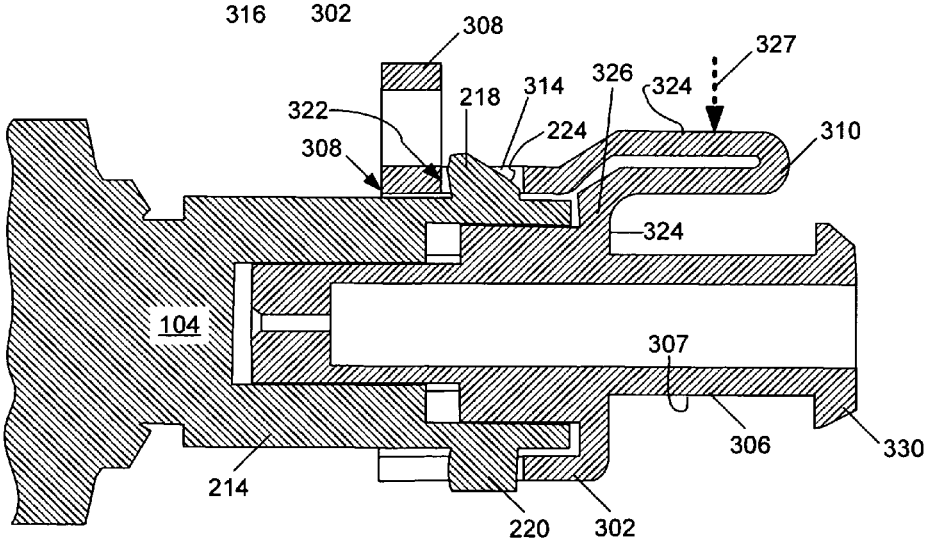
FIG. 4 is a cross section view of two mating connectors latched together.

During connection of the male connector 104 to the female connector 106, the tapered surface 224 of the locking tab 218 touches a leading edge 320 of the latching tab 310, shown in FIG. 4. As the connectors 104 and 106 are pushed closer together during assembly, the leading edge 320 rides on the tapered surface 224 causing the latching tab 310 to deform and move away from the pot body 304. The latching tab 310 may be elastically deformable and regain its original shape after the connectors 104 and 106 are completely connected, and the locking tab 218 is completely within the opening 314. When the connectors 104 and 106 are connected, the tapered surface 224 is past a trailing edge 322 of the latching tab 310 and sits within the opening 314 in the latching tab 310.

The connectors 104 and 106 are held together by an interference between the locking tab 218 and the opening 314. This interference resists forces tending to pull the connectors 104 and 106 apart. To disconnect the connectors 104 and 106, an operator may press against a shelf 324 on the latching tab 310 causing it to deform and rotate about an imaginary pivot point 326 adjacent to a stem 328 where the tab 310 meets the pot body 304. Pressure along a direction 327, denoted by a dashed line arrow, causes a deformation in the tab 310 that may adequately move the opening 314 away from the locking tab 218 and above a height of the tapered surface 224, effectively eliminating the interference between the connectors 104 and 106 and allow for their disassembly. The operator may also use the bridge 308 to push the connectors 104 and 106 apart while pressing on the shelf 324.

There are a number of disadvantages with the connection scheme between the connectors 104 and 106 as described above. First, if a location of these connectors is prone to snagging or pulling during the assembly or installation of the engine 100 in a vehicle, the connectors may become unintentionally disconnected if excessive force is applied to the harness 108. Second, heat from the engine 100 during operation may cause the latching tab 310 to soften and lose some of its rigidity, causing it to be prone to deformation and subsequent release of the locking tab 218. Third, excessive vibration of the engine 100 during operation may cause the latching tab 310 to vibrate and wear some of the material causing the interference with the locking tab 218. Typically, a combined effect of more than one of the above factors may contribute to a premature and unintentional disconnection between the connectors 104 and 106.

Figure 5:
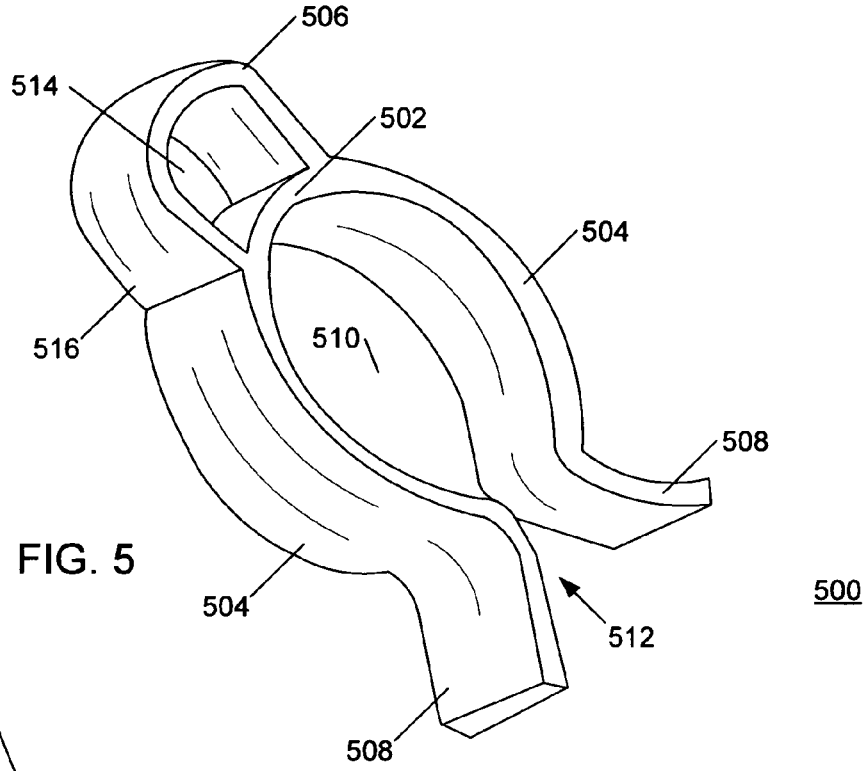
FIG. 5 is a outline view of a clip in accordance with the invention.

In an embodiment of this invention, a clip 500 is used to prevent disconnection of the connectors 104 and 106. The clip 500 is shown in FIG. 5. The clip 500 includes a body 502, a set of legs 504 connected to the body 502, and a head 506. In the embodiment shown, there are two legs 504 connected to the body 502, but more legs may be used. Each leg 504 has a tapered foot 508 on an end opposite the connection to the body 502. The legs 504 are arranged opposite to each other. Each leg 504 has a curved contour. The curved contour of both legs 504 outlines a central opening 510 in the clip 500, with an entrance 512 between the feet 508. A head opening 514 is adjacent to the body 502, and is outlined by a closed wall 516 that is connected on either end to the body 502.

Figure 6:
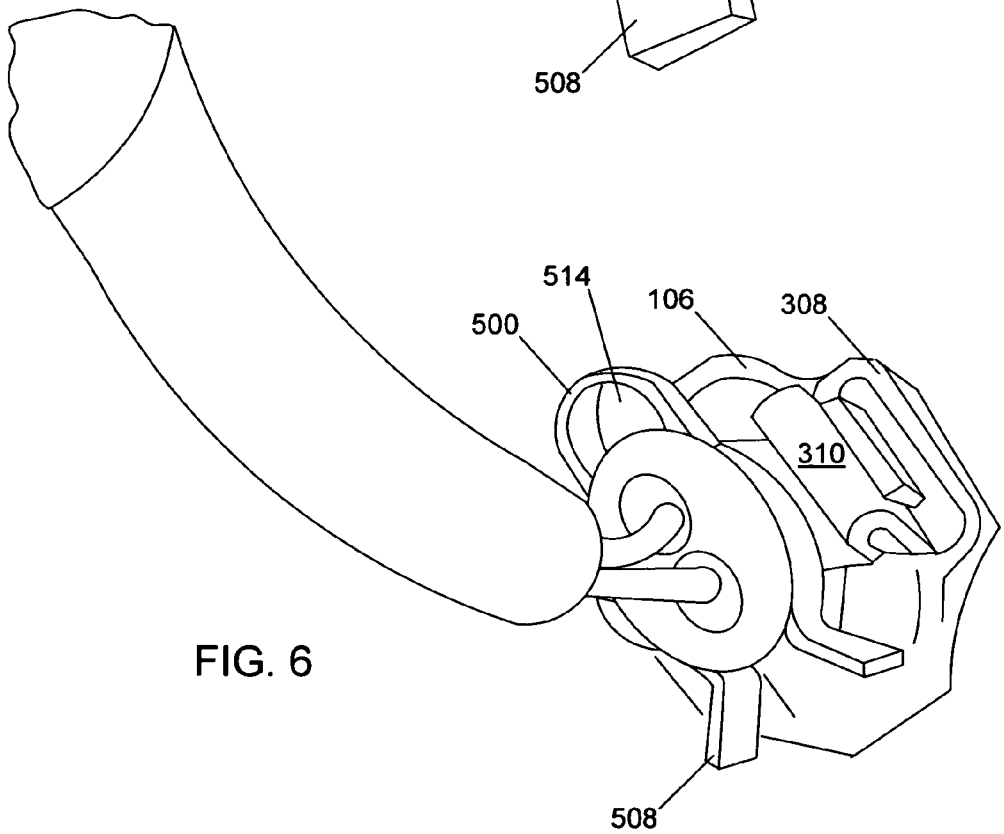
FIG. 6 is an outline view of a clip installed on a connector in accordance with the invention.

The central opening 510 is arranged to fit over the outer surface 307 of the wire housing 306, advantageously, after the female connector 106 has been connected to the male connector 104. Each leg 504 of the clip 500 is deformable to allow for gripping of the outer surface 307 between the legs 504, and also, to allow for the entrance 512 to adequately open and accept the wire housing 306. A clip 500 installed on the female connector 106 is shown in FIG. 6. The clip 500 is installed on the outer surface 307, between the stem 328 and the ledge 330. The head opening 514 is advantageously visible past the ledge 330, to allow for insertion of a tool (not shown), for instance a flat-head screw driver, to help remove the clip 500 from the female connector 106.

Figure 7:
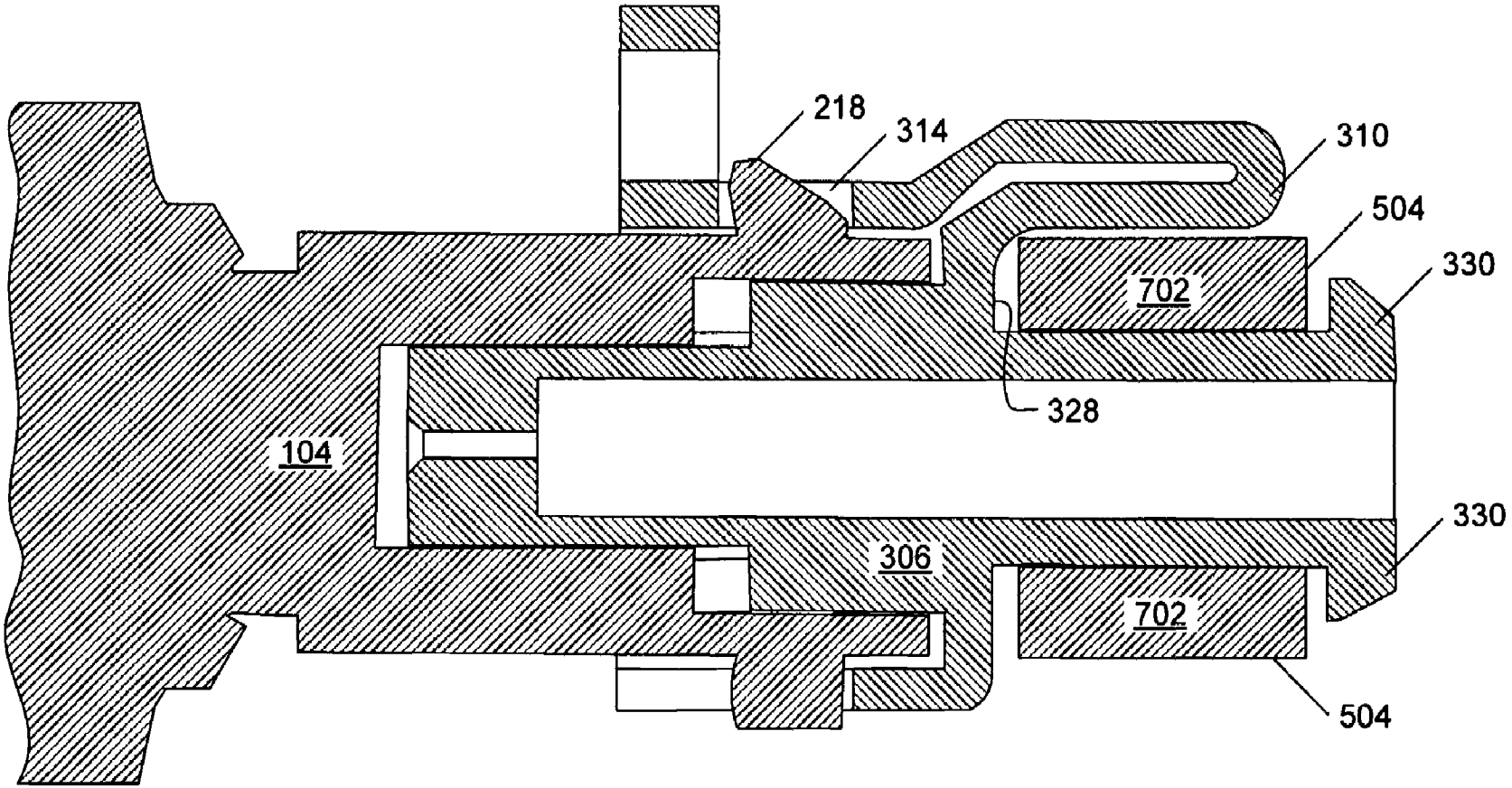
FIG. 7 is a cross section view of two mating connectors latched together and secured with a clip in accordance with the invention.

A view in cross-section of the connectors 104 and 106 in a connected state with the clip 500 installed is shown in FIG. 7. The locking tab 218 on the male connector 104 is shown inserted in the opening 314. A section 702 of each leg 504 sits on the outer surface 307, positioned between the stem 328, the ledge 330, and the latching tab 310. The section 702 prevents the deformation of the latching tab 310 that would release the locking tab 218 from the opening 314 as described earlier. The clip 500 may be inserted in a manufacturing plant by an operator and after the female connector 106 has been latched with the male connector 104. The clip 500 prevents the unintentional removal of the connector 106 from the male connector 194 and, hence, the sensor 102 and the engine 100. Incidence of loose or removed connectors in assembly plants since the implementation of the clip 500 has drastically decreased.

Figure 8:
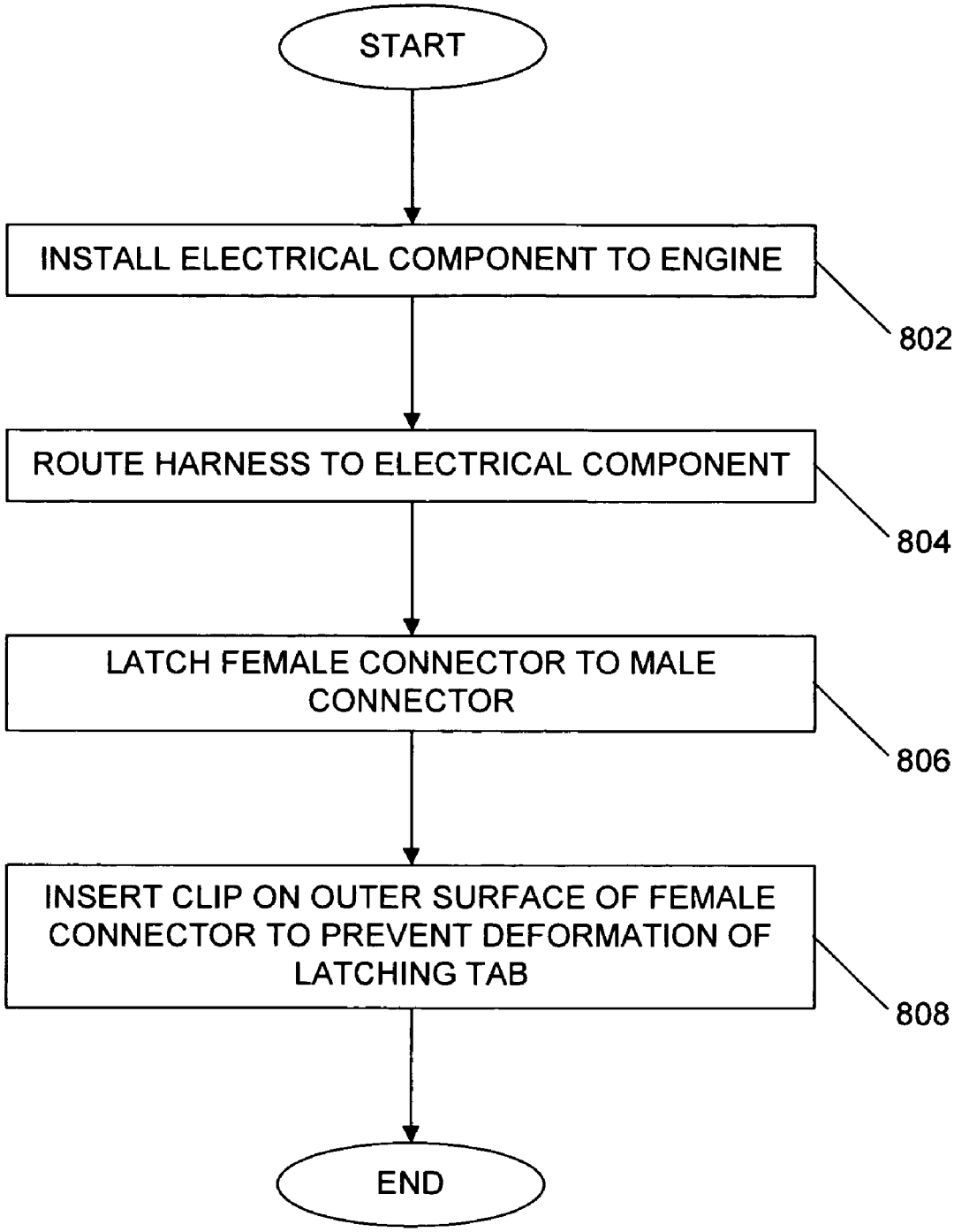
FIG. 8 is a flowchart for a method of securing electrical connectors in accordance with the invention.

A method for securing electrical connectors is presented in the flowchart of FIG. 8. An electrical component is installed on an engine in step 802. The electrical component may be a sensor, actuator, fuel injector, and so forth. An electrical harness is installed on the engine and routed to reach various locations on the engine in step 804. A female connector, which may be a harness-side connector as part of the electrical harness, is connected to a male connector in step 806. The male connector may be integrated with the electrical component. A clip is inserted on an outer surface of the female connector in step 808. The clip prevents the deformation of a latching tab that would release the female connector from the male connector. Removal of the clip to enable disconnection of the mating connectors may be accomplished by insertion of a tool in the head opening of the clip, and pulling the clip off the outer surface of the female connector.

The clip described herein may also advantageously be pre-assembled to the female connector before the female connector is engaged with the male connector. Pre-assembly of the clip to the female connector is advantageous for many reasons, for example, it eliminates an assembly step of installing the clip in a manufacturing environment, and also, it facilitates the assembly process by eliminating the necessity of handling a relatively small clip.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An apparatus, comprising:

a female connector having a first shell, at least one pot, and a latching tab having an opening;

a male connector having a second shell that fits within the first shell, at least one pin disposed within the second shell and in the at least one pot, and a locking tab that is disposed within the opening in the latching tab and that has a tapered surface;

a clip having a body, at least two legs disposed on the body, and a head opening disposed adjacent to the body;

wherein when the male connector is connected to the female connector the clip is disposed on the female connector, and wherein the clip prohibits excessive deformation of the latching tab.

2. The apparatus of claim 1, further comprising a wire housing connected to the female connector, wherein the outer housing includes an outside surface.

3. The apparatus of claim 2, wherein the clip is disposed on the outer surface.

4. The apparatus of claim 2, further comprising a ledge disposed on the outer surface, wherein the latching tab is connected to the female connector at a stem, and wherein the clip is disposed on the outer surface between the stem, the ledge, and the latching tab.

5. The apparatus of claim 1, wherein the clip has two legs.

6. The apparatus of claim 5, wherein each of the two legs has a curved contour, and wherein the two legs form a central opening.

7. The apparatus of claim 1, further comprising a closed wall disposed around the head opening; wherein the closed wall is connected to the body.

8. The apparatus of claim 1, further comprising at least two feet; wherein each of the at least two feet is connected to each of the at least two legs.

9. The apparatus of claim 1, further comprising an entrance opening disposed between the at least two legs; wherein a size of the opening is variable when the at least two legs plastically deform.

10. A clip for an electrical connector, comprising:

a body;

a first leg disposed on a first side of the body, the first leg having a first foot;

a second leg disposed on the first side of the body, the second leg having a second foot;

a head disposed on a second side of the body, wherein a closed wall connected to the body is disposed around the head opening;

wherein the first leg and the second leg each have a curved contour;

wherein a central opening is disposed between the first leg and the second leg; wherein the clip prohibits excessive deformation of a latching tab of the electrical connector when the clip is disposed on the electrical connector; and wherein an entrance is disposed between the first foot and the second foot.

11. The clip of claim 10, wherein the clip is made from plastic.

12. The clip of claim 10, wherein each of the first leg and the second leg are capable of plastic deformation.

13. The dip of claim 10, wherein the head opening is adequately sized to allow for insertion of a tool in the head opening.

14. The clip of claim 10, wherein the body has a shape to match the curved contour of the first leg and the second leg.

15. A method for assuring a position of an electrical connector, comprising the steps of:

installing an electrical component on an engine;

routing an electrical harness adjacent to the electrical component;

latching a female connector to a male connector;

inserting a clip on an outer surface of the female connector;

preventing deformation of a latching tab, thereby preventing a release of the female connector.

16. The method of claim 15, wherein the male connector is connected to the electrical component, and wherein the female connector is connected to the electrical harness.

17. The method of claim 15, wherein the step of inserting the clip includes deforming at least two legs that are connected to the clip around the outer surface.

18. The method of claim 15, further comprising the step of removing the clip from the outer surface of the female connector by inserting a tool through a head opening in the clip.

19. The method of claim 15, wherein the step of inserting a dip precedes the step of latching the female connector to the male connector.

* * * * *